US008033638B2

(12) United States Patent
Umeda

(10) Patent No.: US 8,033,638 B2
(45) Date of Patent: Oct. 11, 2011

(54) INKJET RECORDING DEVICE

(75) Inventor: Takaichiro Umeda, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1056 days.

(21) Appl. No.: 11/856,105

(22) Filed: Sep. 17, 2007

(65) Prior Publication Data

US 2008/0211862 A1 Sep. 4, 2008

(30) Foreign Application Priority Data

Sep. 29, 2006 (JP) ..... 2006-267760

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS 5,644,346 A 7/1997 Schwiebert et al.
6,585,351 B2 * 7/2003 Nakagawa et al. ..... 347/33

FOREIGN PATENT DOCUMENTS

JP 2005-238445 A 9/2005

* cited by examiner

*Primary Examiner* — Jerry Rahll
(74) *Attorney, Agent, or Firm* — Banner & Witcoff, Ltd.

(57) ABSTRACT

An inkjet recording device includes a recording head having a nozzle surface formed with a plurality of nozzle arrays and a wiping mechanism having a wiper for wiping the nozzle surface. The wiping mechanism moves the wiper relative to and in contact with the nozzle surface, in a direction inclined at a predetermined angle with respect to the plurality of nozzles arrays.

15 Claims, 5 Drawing Sheets

INKJET RECORDING DEVICE

CROSS REFERENCE TO RELATED APPLICATION

This application claims priority from Japanese Patent Application No. 2006-267760 filed on Sep. 29, 2006, the entire subject matter of which is incorporated herein by reference.

FIELD

Aspects described herein relate to an inkjet recording device that ejects ink droplets onto a recording medium to record an image thereon.

BACKGROUND

Inkjet recording devices are known that are relatively simple in structure and are capable of readily performing high-speed and high-quality recording. In an inkjet recording device, paper dust or ink mist or dried ink adhering to the surface of a recording head's nozzles might impede ink ejection from the nozzles. To prevent this, cleaning of the nozzle surface of the recording head is performed using a wiper, prior to capping the nozzles or at an appropriate timing during recording operations.

One known system discloses an inkjet recording device designed for color recording, in which a plurality of nozzle arrays are provided on a nozzle surface of a recording head. Each nozzle array corresponds to one of a plurality of color inks. When cleaning of the nozzle surface is performed using a wiper, the wiper is obliquely disposed with respect to the nozzle arrays and is moved along the nozzle surface in a direction parallel with the nozzle arrays such that at least one of the nozzle arrays are wiped earlier than the rest of the nozzle arrays in order to prevent mixing of the various color inks.

SUMMARY

One or more aspects described herein provide an inkjet recording device in which wiping of nozzles are performed effectively while preventing foreign substances from being wiped from one nozzle to another nozzle.

In one embodiment, an ink jet recording device may include a wiping mechanism having a wiper for wiping a nozzle surface having a plurality of nozzle arrays. The plurality of nozzle arrays includes a first nozzle array and a second nozzle array adjacent to the first nozzle array. The wiping mechanism moves the wiper relative to and in contact with the nozzle surface, in a direction inclined at a predetermined angle with respect to the plurality of nozzles arrays. The predetermined angle is smaller than an angle formed with respect to the plurality of nozzle arrays by a straight line drawn between a nozzle to be wiped first in the first nozzle array and a nozzle to be wiped last in the second nozzle array. In another embodiment, the wiper may or may not be angled with respect to the nozzle arrays but may be moved at an angle relative to the nozzle arrays.

These and other aspects are described below.

BRIEF DESCRIPTION OF THE DRAWINGS

These and other aspects and advantages will become apparent from the following detailed description when taken in conjunction with the accompanying drawings, in which.

DETAILED DESCRIPTION

Various illustrative embodiments will be described below with reference to the accompanying drawings.

It is noted that various connections are set forth between elements in the following description. It is noted that these connections in general and, unless specified otherwise, may be direct or indirect and that this specification is not intended to be limiting in this respect.

Figure 1:
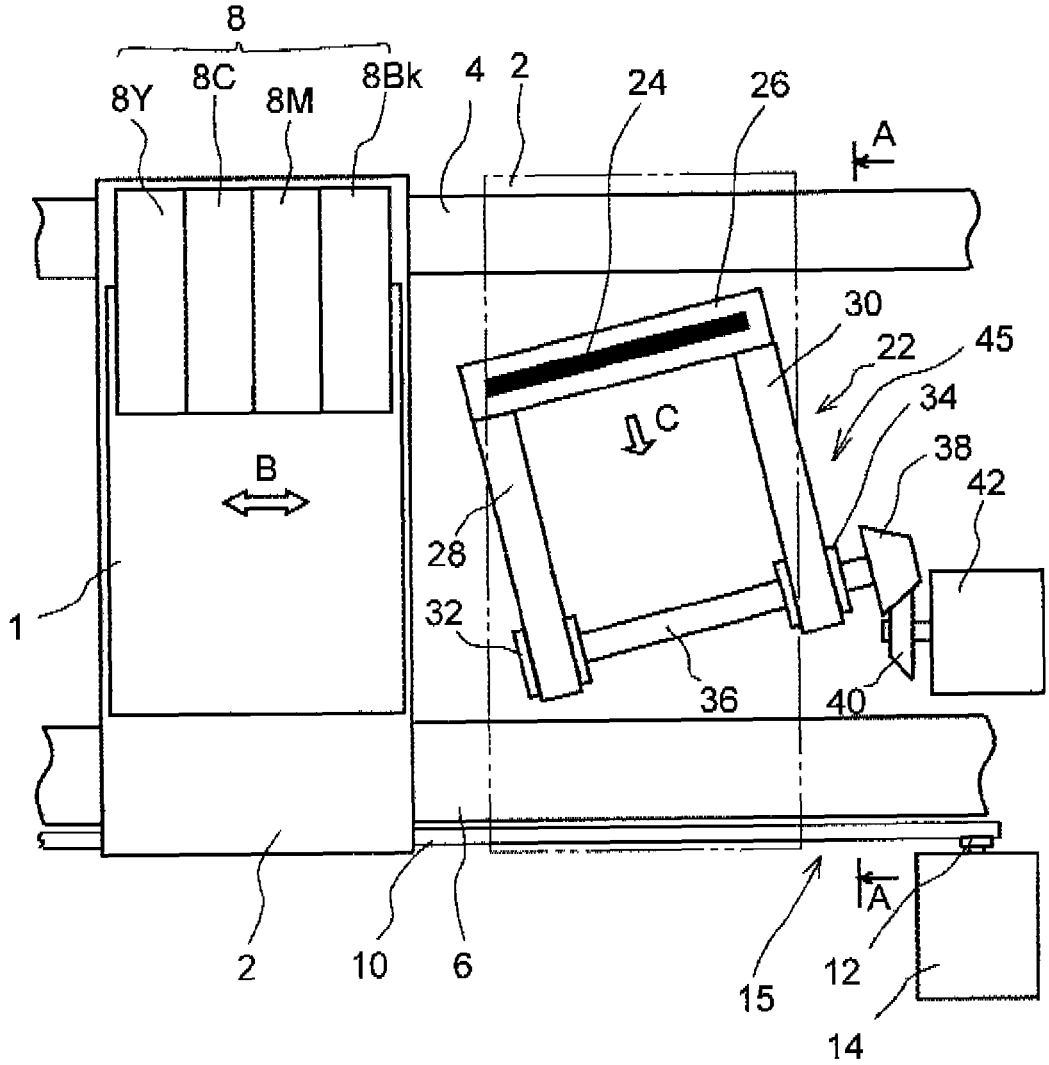
FIG. 1 is a top view showing a general structure of various parts of an inkjet recording device according to a first illustrative embodiment.
Figure 2:
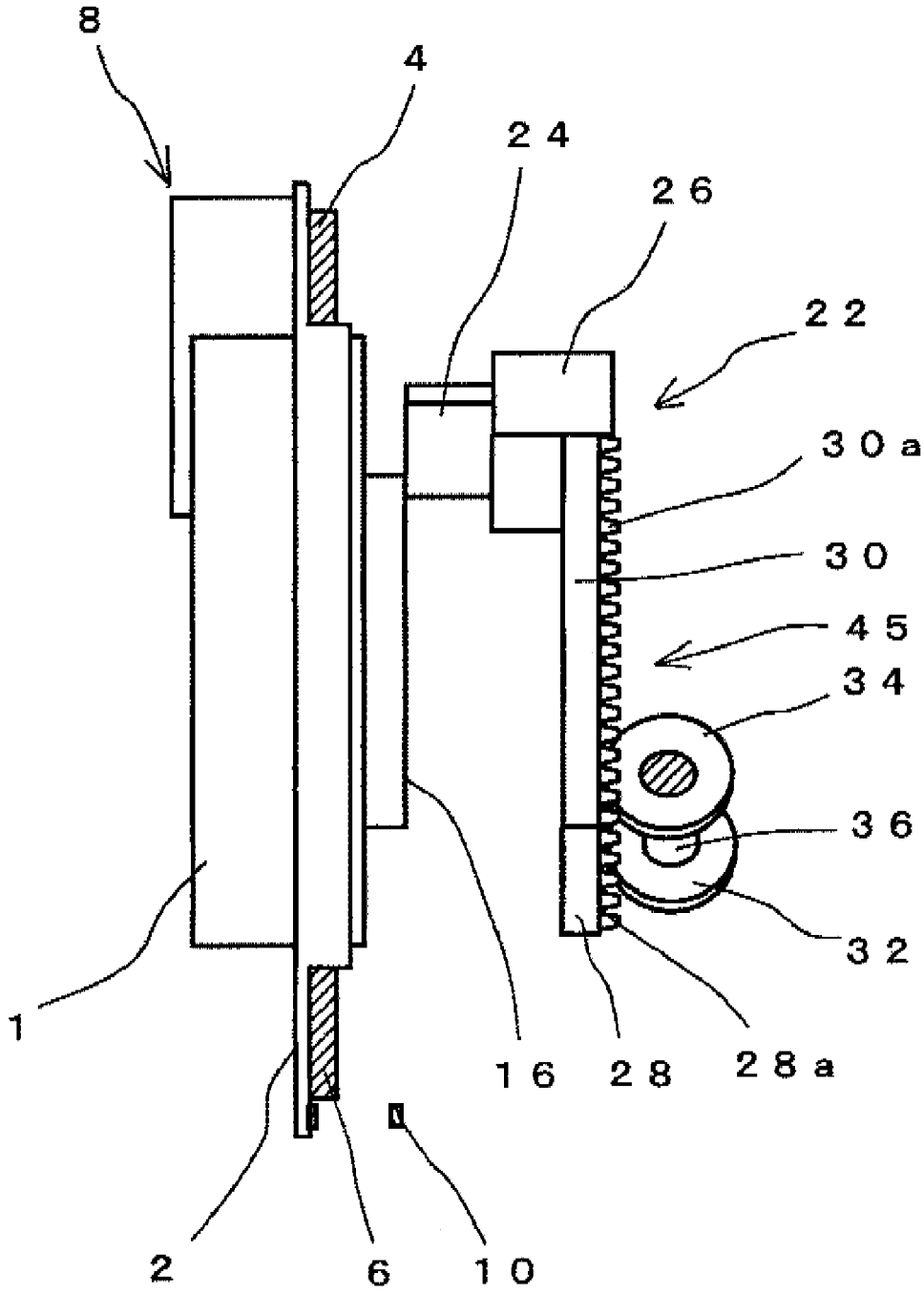
FIG. 2 is a cross-sectional view taken along line A-A of FIG. 1.

FIG. 1 is a top view showing a general structure of various parts of an inkjet recording device according to a first embodiment. FIG. 2 is a cross-sectional view taken along line A-A of FIG. 1. As shown in FIG. 1, a recording head 1 is mounted on a carriage 2, and the carriage 2 is supported by a pair of guide members 4, 6. This arrangement permits the carriage 2 to be linearly movable. Ink tanks 8 are mounted on the carriage 2. In this illustrative embodiment, the recording head 1 is designed for color recording. The ink tanks 8 include a yellow ink tank 8Y, a cyan ink tank 8C, a magenta ink tank 8M, and a black ink tank 8Bk.

A timing belt 10 is disposed along the guide member 6. The timing belt 10 is wound around a pulley 12. The pulley 12 is attached to a motor 14. A part of the timing belt 10 is attached to the carriage 2. When the motor 14 is driven, the carriage 2 reciprocates in directions of arrows B. In this illustrative embodiment, the pair of guide members 4, 6, timing belt 10, pulley 12, and the motor 14 form a carriage moving mechanism 15. The carriage moving mechanism 15 may also include a position sensor, such as an encoder strip (not shown) to detect the position of the carriage.

The recording head 1 includes a nozzle surface 16 (FIG. 2) configured to face a recording medium such as a recording sheet. The nozzle surface 16 is formed with a plurality of nozzles 18. The recording head 1 ejects ink droplets from the nozzles 18 onto the recording medium, thereby forming an ink dot pattern on the recording medium.

Figure 3:
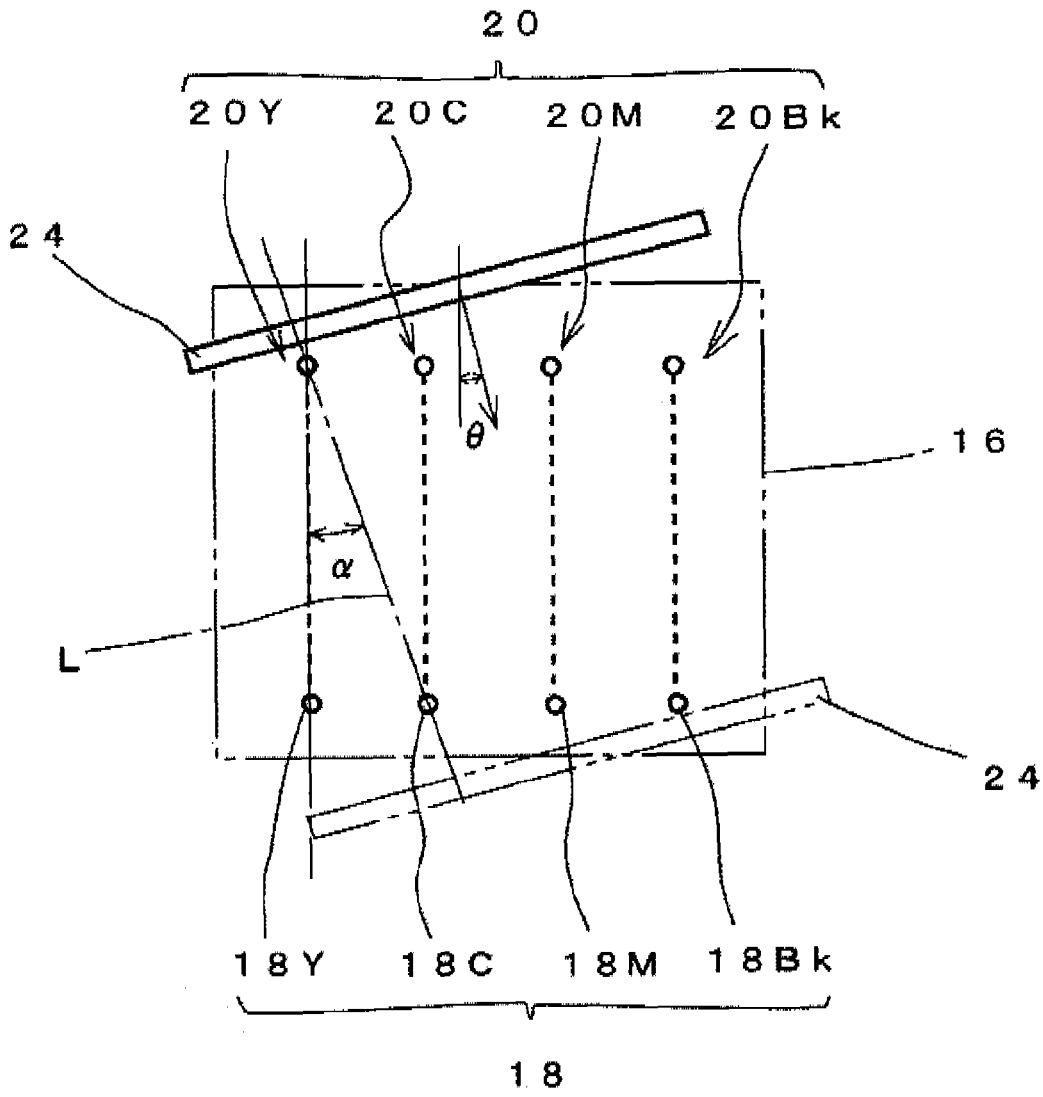
FIG. 3 is an explanatory diagram showing relationship between nozzles and a wiper from the start of wiping to the end of wiping, according to the first illustrative embodiment, when the wiper is viewed from a recording head side.

FIG. 3 shows relationship between the nozzles 18 and a wiper 24 when the wiper 24 is viewed from a side of the recording head 1. As shown in FIG. 3, a plurality of arrays 20 of nozzles (four arrays of nozzles in this illustrative embodiment) may be provided in the nozzle surface 16. The nozzles in an array may be aligned with one another, or they may be staggered to form a wider array.

In this illustrative embodiment, an array 20Y of nozzles 18Y for yellow ink, an array 20C of nozzles 18C for cyan ink, an array 20M of nozzles 18M for magenta ink, and an array 20Bk of nozzles 18Bk for black ink are arranged side by side in four arrays. Alternatively, more or less arrays may be provided based on the color of inks to be used. For instance, three nozzle arrays may be used with a single ink jet recording head. In another example, five or more nozzle arrays may be used. Each nozzle array may be the only nozzle array providing a given ink color or it may be one of two or more nozzle arrays providing the given ink color. It is appreciated that various combinations of nozzle arrays and ink colors may be used and continue to receive the benefits of one or more aspects as disclosed herein.

The nozzle arrays 20Y, 20C, 20M, 20Bk are arranged in a direction perpendicular to the reciprocating directions (shown by arrows B) of the carriage 2 along the pair of guide members 4, 6. Intervals between the nozzle arrays 20Y, 20C, 20M, 20Bk are equal to each other, in this illustrative embodiment.

A wiping mechanism 22 is disposed to face the recording head when the recording head is moved to the wiping position. The wiping mechanism 22 includes the wiper 24 shaped like a plate. The wiper may be made of elastic material such as rubber and/or synthetic resin (e.g., an EPDM material may be used). The wiper may have a predetermined hardness and/or rigidity sufficient for cleaning, such as 30-40 on the shore A hardness scale in compliance with ISO standard. The wiper 24 is configured to move in contact with the nozzle surface 16 to clean the nozzle surface 16.

The wiper 24 is mounted on the movable stand 26. A pair of guide bars 28, 30 are attached to the movable stand 26. The movable stand 26 is supported by the pair of guide bars 28, 30, which are moveably supported by a main body (not shown) of the inkjet recording device.

The moving direction of the movable stand 26 is generally along a direction in which the nozzles 18Y, 18C, 18M, 18Bk are arrayed. The moving direction is inclined at an angle θ with respect to the nozzle arrays 20Y, 20C, 20M, 20Bk.

This inclined angle θ may be set to be smaller than an angle α which is defined between the nozzle array 20Y or 20C or 20M or 20Bk and a straight line L. The line L is a line drawn between a nozzle to be wiped first in one of adjacent two nozzle arrays and a nozzle to be wiped last in the other of the adjacent two nozzle arrays. For example, as shown in FIG. 3, the line L is a line drawn between a nozzle 18Y to be wiped first in the nozzle array 20Y and a nozzle 18C to be wiped last in the nozzle array 20C which is adjacent to the nozzle array 20Y. Having such a smaller angle helps minimize the chance of a part of the wiper 24 wiping nozzles from two adjacent arrays of different colors when the wiper moves across the carriage in one wiping motion.

In this illustrative embodiment, the four nozzle arrays 20Y, 20C, 20M, 20Bk are arranged side by side in order of increasing darkness of color of the inks, namely, in order of yellow, cyan, magenta, and black. The inclined angle θ is set such that the wiper 24 starts wiping with a nozzle in one of adjacent two nozzle arrays, which is for a lighter color ink, and ends wiping with a nozzle in the other of adjacent two nozzle arrays, which is for a darker color ink. For example, as shown in FIG. 3, the inclined angle θ is set such that, in the adjacent nozzle arrays 20Y, 20C, the wiper 24 starts wiping with a nozzle 18Y of the nozzle array 20Y for yellow ink and ends wiping with a nozzle 18C of the nozzle array 20C for cyan ink.

The guide bar 28 is formed, at its axis, with a rack 28*a* while the guide bar 30 is formed, at its axis, with a rack 30*a*. The rack 28*a* is engaged with a pinion gear 32 while the rack 30*a* is engaged with a pinion gear 34. The pinion gears 32, 34 are attached to a rotating shaft 36, and a helical gear 38 is also attached to the rotating shaft 36.

A small helical gear 40 engaged with the helical gear 38 is driven to rotate by a motor 42. In this illustrative embodiment, the pair of guide bars 28, 30, pinion gears 32, 34, helical gear 38, small helical gear 40, and the motor 42 may form a guide mechanism 45.

When the motor 42 is driven to rotate, the guide bars 28, 30 are moved, via the small helical gear, helical gear 38, pinion gears 32, 34, and the racks 28*a*. 30*a*, in a direction inclined at the angle θ with respect to the nozzle arrays 20*y*, 20C, 20M, 20Bk. At this time, the wiper 24 is configured to move in contact with the nozzle surface 16. The plate-shaped wiper 24 may be perpendicular to the guide bars 28, 30, and may move in a direction inclined at the angle θ with respect to the arrays. The wiper 24 may be wide enough to extend across the nozzles arrays 20Y, 20C, 20M, 20Bk and to pass over all the nozzles 18Y 18C, 18M, 18Bk when it moves in contact with the nozzle surface 16.

Operations of the inkjet recording device according to the first illustrative embodiment will now be described. In order to prevent ink ejection failure due to paper dust or ink mist adhering to the nozzle surface 16, wiping is performed using the wiper 24 before the nozzles 18Y, 18C, 18M, 18Bk are capped by a capping member (not shown) or at an appropriate timing during recording operations.

In order to perform wiping, the motor 14 is driven to move the carriage 2 to a position indicated by a double dotted line in FIG. 1 such that the nozzle surface 16 faces the wiping mechanism 22. Then the motor 42 is driven to move the movable stand 26 in a direction (direction C in FIG. 1) inclined at the angle θ with respect to the nozzle arrays 20Y, 20C, 20M, 20Bk.

As it moves, the wiper 24 contacts the nozzle surface 16 to wipe and remove foreign substances such as paper dust, other dust, and viscous and/or hardened ink.

The wiper 24 moves in the direction inclined at the angle θ while removing the foreign substances. Thus, as the wiper 24 moves, the foreign substances are moved in the direction inclined at the angle θ. When the wiper 24 has passed all the nozzles 18Y, 18C, 18M, 18Bk and has cleaned generally the nozzle surface 16 at least covering the nozzles 18Y, 18C, 18M, 18Bk, as shown by the double dotted line in FIG. 3, driving of the motor 42 is stopped to stop the wiper 24. The wiper 24 may be reset to its original position after the recording head 1 has moved away from wiper 24.

In this way, since the wiper 24 moves at the inclined angle θ, foreign substances such as dust and ink wiped earlier from the nozzles 18Y for yellow ink are unlikely to be conveyed or pushed into the nozzles 18C for cyan ink that are wiped later. Thus, ink ejection failure due to adhesion of foreign substances to the nozzles 18C and mixture of yellow ink and cyan ink are minimized and/or prevented.

Furthermore, in the nozzles 18Y, 18C, 18M, 18Bk in the respective nozzle arrays 20Y, 20C, 20M, 20Bk, foreign substances wiped earlier from any nozzles in the same nozzle array are unlikely to adhere to other nozzles in the same nozzle array. For example, foreign substances wiped from any nozzles 18Y in the nozzle array 20Y for yellow ink are unlikely to be conveyed to and adhere to other nozzles 18Y in the same nozzle array 20Y located in a downstream side of the wiper moving direction.

In the first illustrative embodiment, wiping is performed in a simple manner by the wiping mechanism 22 that moves the wiper 24 linearly. The wiper 24 is designed to wipe the nozzles for lighter color inks earlier than the nozzles for darker color inks, lessening influence of mixture of color inks if happens. In addition, since the wiper 24 formed into a single plate is disposed perpendicular to the wiper moving direction, the wiper 24 can remove the foreign substances all the way in the wiper moving direction.

Figure 4:
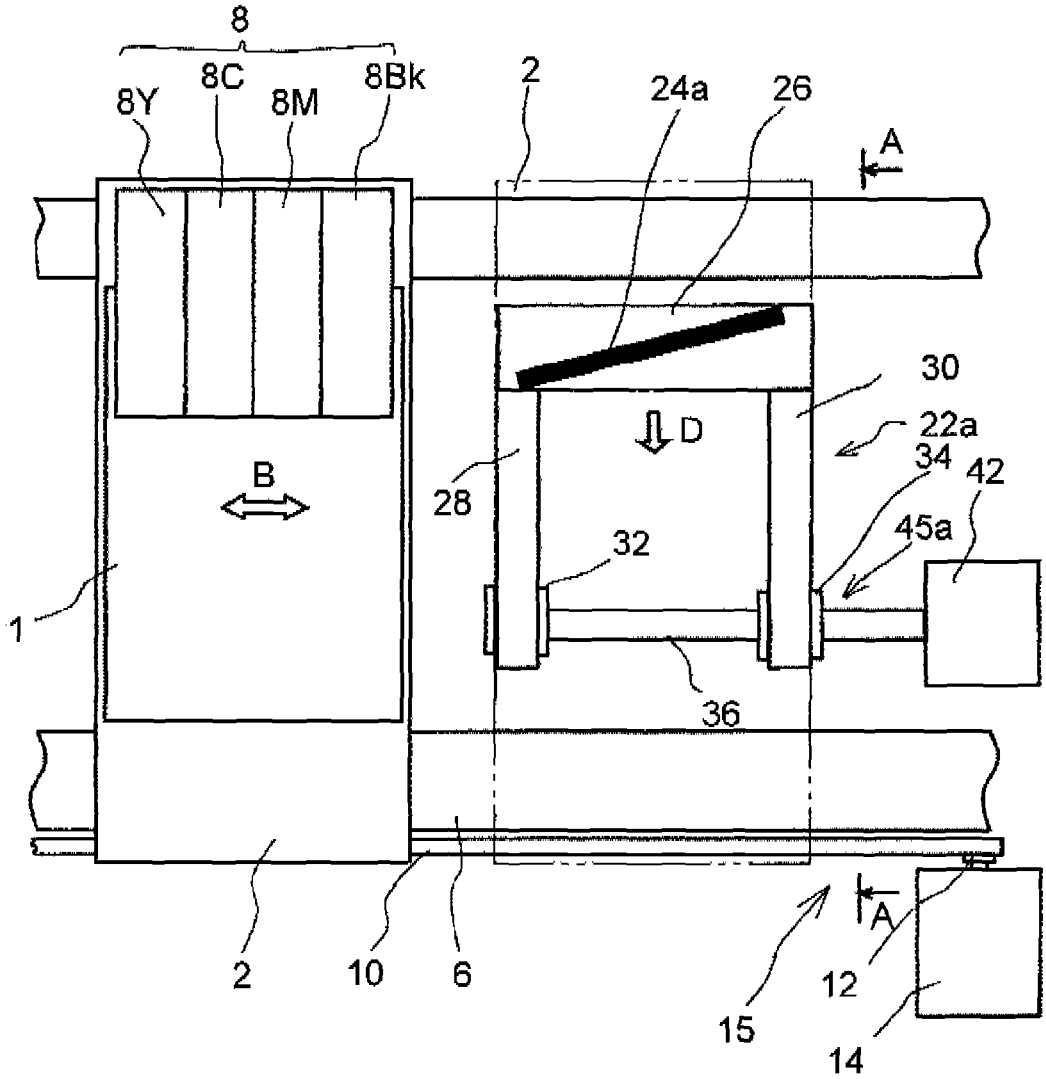
FIG. 4 is a top view showing a general structure of various parts of an inkjet recording device according to a second illustrative embodiment.
Figure 5A:
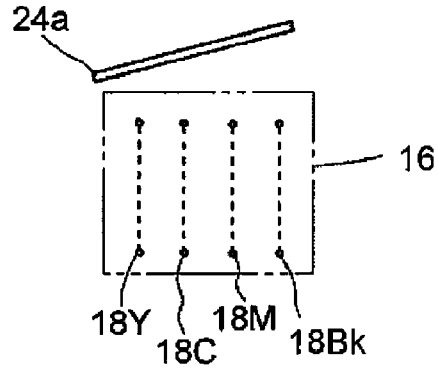
FIGS. 5A through 5E are explanatory diagrams showing relationship between nozzles and a wiper from the start of wiping to the end of wiping, according to the second illustrative embodiment, when the wiper is viewed from a recording head side.
Figure 5B:
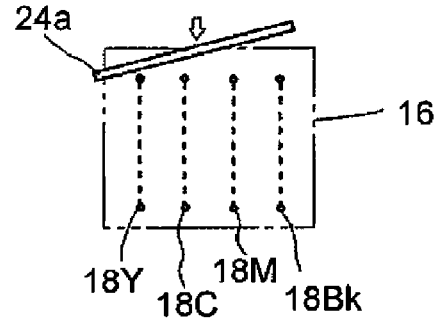

An inkjet recording device according to a second illustrative embodiment will now be described with reference to FIGS. 4 and 5A through 5E. FIG. 4 is a top view showing a general structure of various parts of the inkjet recording device according to the second illustrative embodiment. FIGS. 5A through 5B are explanatory diagrams showing relationship between nozzles 18 and a wiper 24*a* when the wiper 24*a* is viewed from a side of a recording head 1. The same reference numerals are used for the same parts as those in the first illustrative embodiment, and detailed descriptions thereof are omitted.

A wiping mechanism 22*a* in the second illustrative embodiment is different from the wiping mechanism 22 in the first illustrative embodiment in that guide bars 28, 30 are perpendicular to guide members 4, 6 for a carriage 2. In a guide mechanism 45*a*, a rotating shaft 36 is driven by a motor 42. When the motor 42 is driven, a movable stand 26 moves in a direction perpendicular to the moving direction of the carriage 2. The wiper 24*a* is attached to the movable stand 26 at the angle θ, which has been described in the first illustrative embodiment, inclined with respect to the moving direction of the movable stand 26.

In order to perform wiping in the second illustrative embodiment, a motor 14 of a carriage moving mechanism 15 and the motor 42 of the guide mechanism 45*a* are simultaneously driven and controlled such that the movable stand 26 moves in a direction of an arrow D while the carriage 2 moves in directions of arrows B. At this time, the moving direction of the wiper 24 relative to the nozzle surface 16 results in a direction inclined at the angle θ with respect to the nozzle arrays 20Y, 20C, 20M, 20Bk. This may be accomplished by adjusting the speeds of the carriage and wiper. For example, the speeds may be adjusted so that in the time the wiper moves across the carriage (e.g. from the first nozzle of the nozzle array 20Y to the last nozzle of the nozzle array 20C), the carriage moves a distance more than 0 and less than one pitch (a) (the distance between nozzle arrays on the carriage). To illustrate, if the wiper moves a distance (L1) in time (t) at a speed (v1=L1/t), then the carriage may move at a speed (v2) more than 0 and less than ((a)(v1))/(L1). In order to minimize the amount of the wiper that is not used (in other words, that does not wipe at least one nozzle) during the wiping motion, the speeds may be adjusted to maximize usage of the wiper and yet still avoid contaminating nozzles. For example, the speeds may be adjusted so that in the time the wiper moves across the carriage, the carriage moves a distance not less than 0.5 pitch (0.5a) and less than one pitch (a). In some embodiments, the speeds may be adjusted so that in the time the wiper moves across the carriage, the carriage moves a distance not less than 0.8 pitch (0.8a) and less than one pitch (a).

Figure 5C:
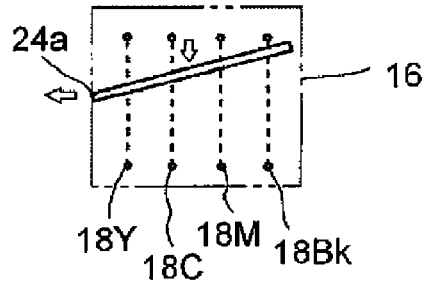

For example, as shown in FIGS. 5A and 5B, the motor 42 is driven to move the movable stand 26 such that the wiper 24 is moved from a stand-by position (FIG. 5A) to a wiping start position (FIG. 5B) where the wiper 24 is positioned at a nozzle 18Y to be wiped first. Then, as shown in FIGS. 5C and 5D, the motors 14, 42 are simultaneously controlled such that the moving direction of the wiper 24*a* relative to the nozzle surface 16 results in the direction inclined at the angle θ.

Figure 5D:
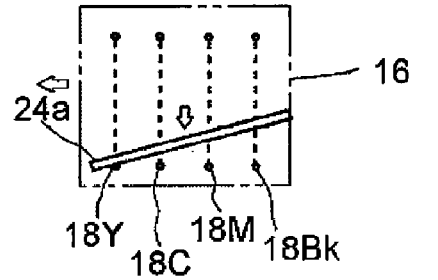

Specifically, the motor 42 is driven to move the wiper 24 while the motor 14 is driven to move the nozzle surface 16 of the recording head 1, such that the wiper 24*a* moves relative to the nozzle surface 16 at the inclined angle θ from one end of the nozzles arrays 18Y, 18C, 18M, 18Bk (FIG. 5C) to the other end of the nozzle arrays 18Y, 18C, 18M, 18Bk (FIG. 5D).

Figure 5E:
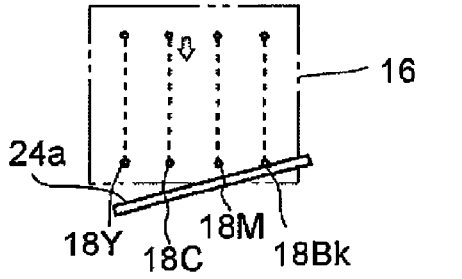

Next, as shown in FIG. 5E, when the wiper has passed a nozzle 18Bk to be wiped last, wiping is completed and the motors 14, 42 are stopped. In this way, wiping can be performed by moving the wiper 24*a* relative to nozzle surface 16 at the inclined angle θ.

In the second illustrative embodiment, similarly to the first illustrative embodiment, foreign substances wiped earlier from any nozzle in one nozzle array are unlikely to adhere to another nozzle wiped later in the same nozzle array or in another nozzle array. Accordingly, ink ejection failure due to adhesion of foreign substances to the nozzles and mixture of color inks can be minimized or prevented. Since nozzles for lighter color inks are wiped earlier than nozzles for darker color inks, influence of mixture of color inks if happens is lessened. In addition, since the wiper 24*a* is perpendicular to the moving direction of the wiper 24*a* relative to nozzle surface 16 and is wide enough to extend across the nozzles arrays 18Y, 18C, 18M, 18Bk, the wiper 24*a* can remove the wiped foreign substances all the way in the relative moving direction of the wiper 24*a*.

Furthermore, in the second illustrative embodiment, since wiping can be performed by moving the wiper 24*a* and the carriage 2 in directions that are perpendicular to each other, arrangement of the wiper mechanism 22*a* with respect to the guide members 4, 6 for the carriage 2 is simplified.

The wipers 24 and 24*a* are shown angled with respect to a line perpendicular to the nozzle arrays. Alternatively, the wipers 24 and 24*a* may be perpendicular to the nozzle arrays. While, depending on the motion speeds, perpendicular wipers 24 and 24*a* may not be able to effectively prevent one color ink from being wiped to nozzles of another color of ink (darker color ink to lighter color ink), the ink color mixing may be less of an issue where the arrays of nozzles output the same color of ink. For instance, aspects herein may be used with a high-resolution monochromatic ink jet printer in which the wipers 24 and 24*a* move relative to the nozzles at angle θ but the wipers 24 and 24*a* themselves are perpendicular to the nozzle arrays.

The ink jet recording device described above is shown with one ink jet recording head. Alternatively, multiple ink jet recording heads may be provided each with their own wiper mechanism or using a common wiper mechanism. The multiple ink jet heads may include any number of nozzle arrays where there nozzle arrays are effectively cleaned by the wiper mechanism or wiper mechanisms.

While the discussion above has been described in conjunction with specific illustrative embodiments thereof, it is evident that many alternatives, modifications and variations may be apparent to those skilled in the art. Accordingly, the embodiments set forth herein are intended to be illustrative, not limiting. Various changes may be made without departing from the spirit and scope of the invention as defined in the following claims.

What is claimed is:

1. An inkjet recording device comprising:

a recording head having a nozzle surface formed with a plurality of nozzle arrays and configured to eject ink droplets from the plurality of nozzle arrays, the plurality of nozzle arrays including a first nozzle array and a second nozzle array adjacent to the first nozzle array;

a wiping mechanism having a wiper for wiping the nozzle surface;

a carriage on which the recording head is mounted; and a carriage moving mechanism that guides the carriage in a direction perpendicular to the plurality of nozzle arrays, wherein the wiping mechanism moves the wiper relative to and in contact with the nozzle surface, in a direction inclined at a predetermined angle with respect to the plurality of nozzles arrays, the predetermined angle being smaller than an angle formed with respect to the plurality of nozzle arrays by a straight line drawn between a nozzle to be wiped first in the first nozzle array and a nozzle to be wiped last in the second nozzle array, and wherein the wiping mechanism includes a guide mechanism that guides the wiper in a direction parallel with the plurality of nozzle arrays, the guide mechanism and the carriage moving mechanism being controlled such that the wiper moves in the inclined direction relative to the nozzle surface.

2. The inkjet recording device according to claim 1, wherein the first and second nozzle arrays are separated by a distance of one pitch, and said device is configured such that when the wiper moves from the nozzle to be wiped first in the first nozzle array to the nozzle to be wiped last in the second nozzle array, the carriage moves in a direction perpendicular to the first and second nozzle arrays by a distance of not less than 0.5 pitch, and less than 1.0 pitch.

3. The inkjet recording device according to claim 2, wherein said device is configured such that when the wiper moves from the nozzle to be wiped first in the first nozzle array to the nozzle to be wiped last in the second nozzle array, the carriage moves in a direction perpendicular to the first and second nozzle arrays by a distance of not less than 0.8 pitch, and less than 1.0 pitch.

4. A method comprising:

moving an ink et recording head to a predetermined position, the ink jet recording head including at least a first nozzle array and a second nozzle array on a nozzle surface; and wiping the nozzle surface by moving at a non-zero angle relative to the first nozzle array a wiper, where the angle is less than an angle between the first nozzle array and a line formed between a first nozzle on the first nozzle array and a last nozzle on the second nozzle array, wherein the first and second nozzle arrays are parallel to each other and separated by a distance of one pitch, and when the nozzle surface is wiped by moving the wiper at the non-zero angle relative to the first nozzle array from the first nozzle on the first nozzle array to the last nozzle on the second nozzle array, the wiper is moved, relative to the nozzle surface, in a direction perpendicular to the first and second nozzle arrays by a distance of not less than 0.5 pitch, and less than 1.0 pitch.

5. The method according to claim 4, wherein the wiper extends along a line that is perpendicular to the direction of movement of the wiper.

6. The method according to claim 4, where the wiper is perpendicular to the first nozzle array.

7. An inkjet recording device comprising:

a recording head having a nozzle surface formed with a plurality of nozzle arrays and configured to eject ink droplets from the plurality of nozzle arrays, the plurality of nozzle arrays being arranged in parallel with each other and including a first nozzle arrays and a second nozzle array adjacent to the first nozzle array; and a wiping mechanism having a wiper for wiping the nozzle surface;

wherein the wiping mechanism moves the wiper relative to and in contact with the nozzle surface, in a direction inclined at a predetermined angle with respect to the plurality of nozzles arrays, the predetermined angle being smaller than an angle formed with resect to the plurality of nozzle arrays by a straight line drawn between a nozzle to be wiped first in the first nozzle array and a nozzle to be wiped last in the second nozzle array, and wherein the first and second nozzle arrays are separated by a distance of one pitch, and said device is configured such that when the wiper moves from the nozzle to be wiped first in the first nozzle array to the nozzle to be wiped last in the second nozzle array, the wiper moves, relative to the nozzle surface, in a direction perpendicular to the first and second nozzle arrays by a distance of not less than 0.5 pitch, and less than 1.0 pitch.

8. The ink jet recording device according to claim 7, wherein the wiper is plate-shaped and is wide enough to extend across the plurality of nozzle arrays when the wiper is moved relative to and in contact with the nozzle surface.

9. The inkjet recording device according to claim 7, wherein the plurality of nozzle arrays are arranged on the nozzle surface at uniform intervals therebetween.

10. The inkjet recording device according to claim 7, wherein the wiper is perpendicular to the wiping direction.

11. The inkjet recording device according to claim 7, wherein the wiper is perpendicular to the nozzle arrays.

12. The inkjet recording device according to claim 7, wherein the wiping mechanism includes a guide mechanism that guides the wiper linearly in the inclined direction.

13. The inkjet recording device according to claim 12, wherein the guide mechanism includes a guide member extending parallel to the inclined direction and configured to guide the wiper in the inclined direction.

14. The inkjet recording device according to claim 7, wherein the recording head ejects a first ink from the first nozzle array and a second ink from the second nozzle array, the second ink being darker in color than the first ink, and the wiping mechanism moves the wiper such that the wiper starts wiping with the first nozzle array and ends wiping with the second nozzle array.

15. The inkjet recording device according to claim 7, wherein the wiper is oriented to be perpendicular to the inclined direction.

* * * * *

UNITED STATES PATENT AND TRADEMARK OFFICE

CERTIFICATE OF CORRECTION

PATENT NO. : 8,033,638 B2
APPLICATION NO. : 11/856105
DATED : October 11, 2011
INVENTOR(S) : Takaichiro Umeda It is certified that error appears in the above-identified patent and that said Letters Patent is hereby corrected as shown below:

Column 7, Claim 4, Line 28:
Please delete “ink et recording” and insert --ink jet recording--

Column 8, Claim 7, Line 3:
Please delete “first nozzle arrays” and insert --first nozzle array--

Column 8, Claim 7, Line 11:
Please delete “formed with resect to” and insert --formed with respect to--

Signed and Sealed this
Twenty-eighth Day of August, 2012

David J. Kappos

David J. Kappos
*Director of the United States Patent and Trademark Office*